US008176745B1

(12) United States Patent
Korza et al.

(10) Patent No.: US 8,176,745 B1
(45) Date of Patent: May 15, 2012

(54) DRINKING-GAME THERMAL-RACKING SYSTEMS

(75) Inventors: Alex Korza, Phoenix, AZ (US); Chris Scott, Phoenix, AZ (US)

(73) Assignee: Scorza Industries Limited Company, Phoenix, AZ (US)

( * ) Notice: Subject to any disclaimer, the term of this patent is extended or adjusted under 35 U.S.C. 154(b) by 0 days.

(21) Appl. No.: 12/346,106

(22) Filed: Dec. 30, 2008

Related U.S. Application Data

(60) Provisional application No. 61/017,796, filed on Dec. 30, 2007.

(51) Int. Cl.
*F25D 23/12* (2006.01)

(52) U.S. Cl. ..... 62/258

(58) Field of Classification Search ..... 62/258, 62/458

See application file for complete search history.

(56) References Cited

U.S. PATENT DOCUMENTS

| | | | | |
|---|---|---|---|---|
| 4,762,327 | A | 8/1988 | Gomez | |
| 7,004,465 | B2 | 2/2006 | Keith | |
| 7,207,565 | B1 | 4/2007 | Masty, III | |
| 7,325,807 | B1 * | 2/2008 | Eason | 273/342 |
| 2004/0188942 | A1 | 9/2004 | Trokan | |
| 2005/0029747 | A1 | 2/2005 | Grayson | |
| 2005/0133993 | A1 | 6/2005 | Keith | |
| 2006/0226606 | A1 | 10/2006 | Finley et al. | |
| 2007/0107460 | A1 | 5/2007 | Webb et al. | |

OTHER PUBLICATIONS

Banjo, Shelly, "College Entrepreneurs cash in with beer pong", newspaper/website article, Aug. 29, 2007, azcentral.com.

* cited by examiner

*Primary Examiner* — Melvin Jones
(74) *Attorney, Agent, or Firm* — Andrew P. Lahser

(57) ABSTRACT

This disclosure teaches an apparatus suitable for playing a drinking game using drinking cups and thrown projectiles on a playing surface having a rack to rack up a pre-determined configuration of the drinking cups. The rack includes an insulator to at least partially insulate the drinking cups and an electric cooler to cool the drinking cups during game play.

22 Claims, 12 Drawing Sheets

DRINKING-GAME THERMAL-RACKING SYSTEMS

CROSS REFERENCE TO RELATED APPLICATIONS

The present application is related to prior provisional application Ser. No. 61/017,796 filed Dec. 30, 2007, the contents of which are incorporated herein by this reference and are not admitted to be prior art with respect to the present invention by the mention in this cross-reference section.

DETAILED DESCRIPTION

Figure 1:
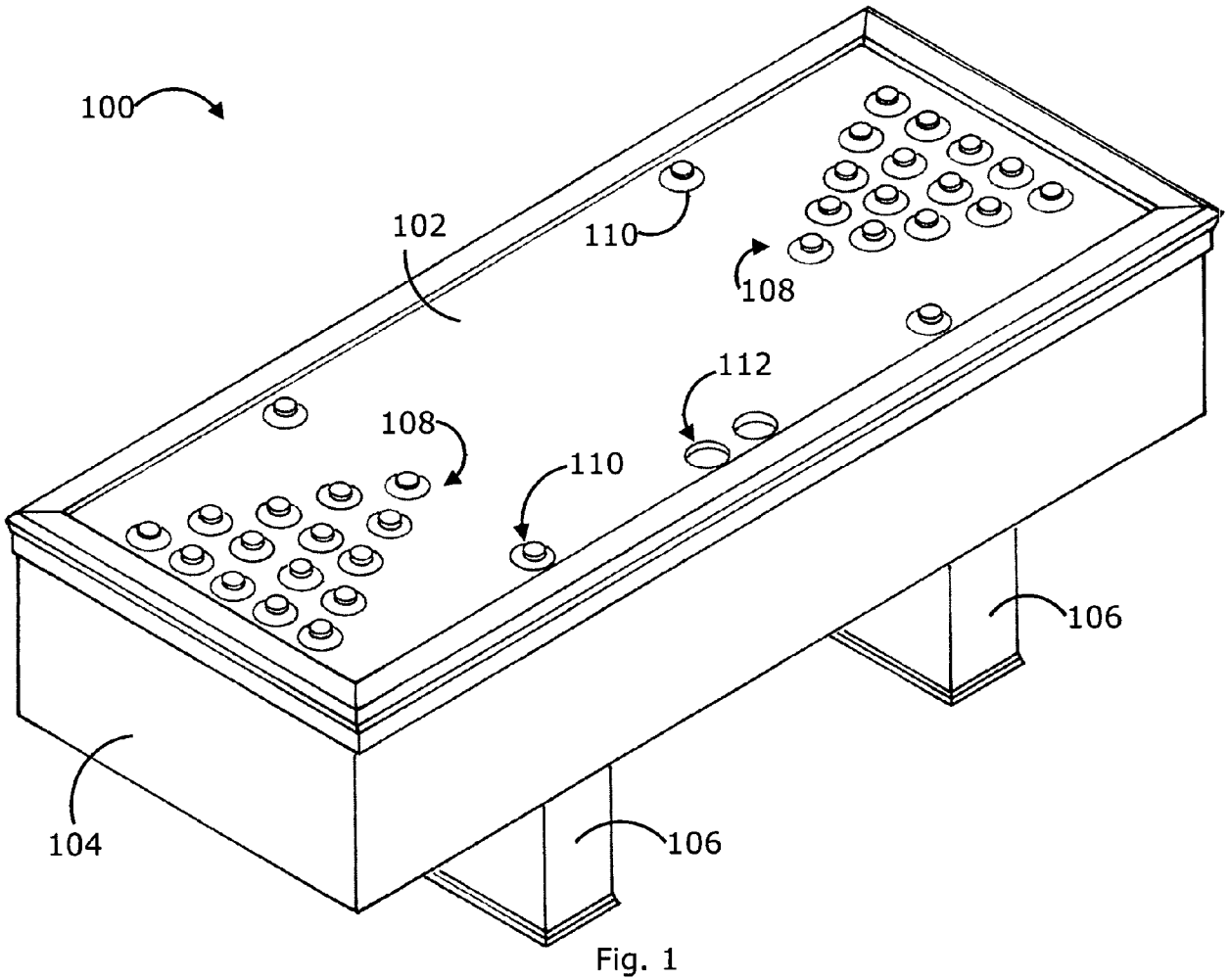
FIG. 1 shows a perspective view illustrating a drinking-game cup thermal racking system according to an embodiment of the present invention.
Figure 2:
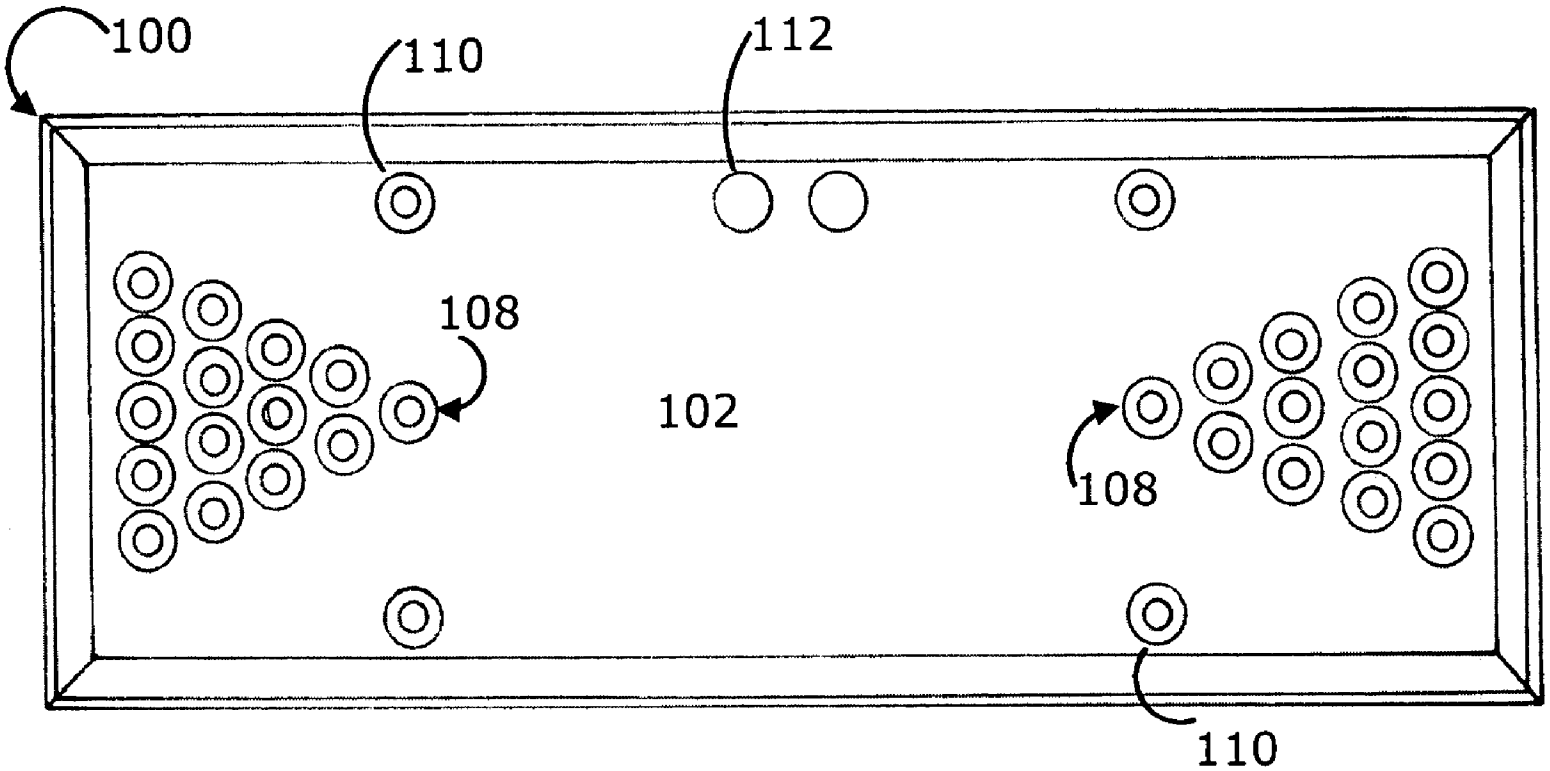
FIG. 2 shows a top view illustrating the playing surface of a drinking-game thermal-racking system according to the embodiment of FIG. 1.

FIG. 1 shows a perspective view illustrating a drinking-game thermal-racking system according to an embodiment of the present invention. Drinking-game thermal-racking system 100 may provide for playing drinking games using drinking cups containing beverages and thrown projectiles (not shown) for tossing into the drinking cups. Drinking-game thermal-racking system 100 may keep the beverage contained in the drinking cups chilled for the duration of the drinking game. FIG. 2 shows a top view illustrating the playing surface of a drinking-game thermal-racking system according to the embodiment of FIG. 1. (See also FIG. 5*a* and FIG. 5*b*, which show side views, and FIG. 5*c*, which shows a perspective view of a base support of a drinking-game thermal-racking system according to the embodiment of FIG. 1.)

Now, with reference to FIG. 1, FIG. 2 and FIGS. 5*a* to 5*c*, drinking games may be played on the playing surface 102, as shown. Playing surface 102 may be held within the table body 104 and may be supported by table legs 106, as shown. Playing surface 102 may be similar in width and length to a ping pong table, as shown. Playing surface 102 may be about 48 inches above the floor, as shown. Playing surface 102 may be other widths, heights or lengths, depending on the rules of the drinking game, the preference or requirements of user, local custom and other similar factors.

Playing surface 102 may contain rack area 108, as shown. Rack area 108 may contain a formation of cup holders that holds the drinking cups in a pre-determined configuration suitable for playing drinking games, as shown. FIG. 1 and FIG. 2 show drinking cup configurations with fifteen cups organized into five rows (on each side of the playing surface), with one cup holder in the first row, two cup holders in the second row, three cup holders in the third row, four cup holders in the fourth row, five cup holders in the fifth row and two cup holders on each side for holding penalty drinking cups 110, as shown. Rack areas 108 may provide for uniform alignment and placement of drinking cups even during extended play, as shown. The drinking cup holder may be for standard size disposable drinking cups, such as 16 ounce plastic cups, 12 ounce plastic cups, 8 ounce plastic cups, or other sizes and shapes. Some drinking cups may contain measuring lines for measuring the amount of beverage contained within the cup. Alternately, drinking cups may be designed and provided specifically for use the drinking-game thermal-racking systems, such drinking cups may be integrated into the operation of the system, including the thermal, lighting, cooling, heating, and sealing characteristics further described herein. Warming cup holders 112 may be used as ball washers, as shown, which may also be called a rinse cup, courtesy cup or water cup, which may be used whenever a thrown projectile may become dirty, such as, for example, when it is dropped on the floor. Warming cup holders 112 may alternately be used as penalty cup holders with a warm beverage.

Playing surface 102 may be adapted for playing a variety of drinking games. Playing surface 102 may be used to play "beer pong", which may also be called "Beruit," or "Beirut," and is sometimes called "Ruit," or "Lob pong", and may be known by other names. The game may derive its name from the type of thrown projectile. The thrown projectiles may be table tennis balls or ping pong ball, such as those found in a 38 mm or 40 mm diameter. Another thrown projectile may be a quarter coin (i.e. a US twenty-five cent coin) or other coins of similar size or heft. When a quarter is used, the drinking game may be known as "quarters." Other types of thrown projectiles may be used depending on the rules of the game agreed upon by the players. While there is no recognized authority on the rules of beer pong, many variations of the game share similar rules. By way of example, some methods of playing beer pong will be described including its relationship to drinking-game thermal-racking systems 100.

Figure 3A:
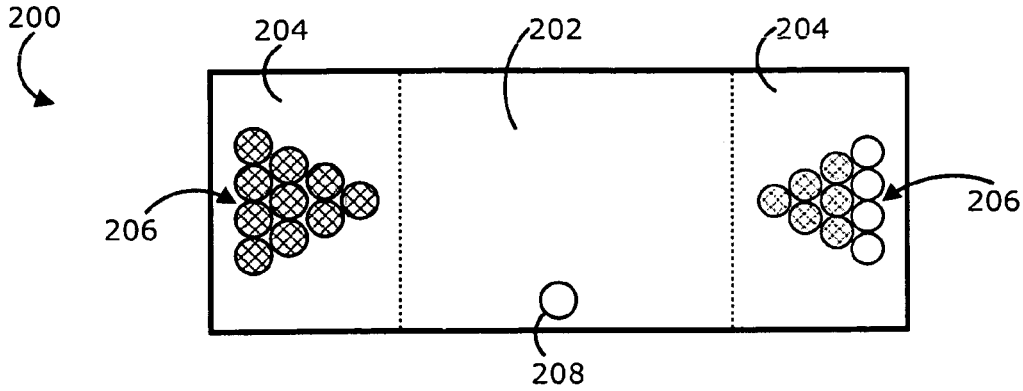
FIG. 3*a*, FIG. 3*b*, and FIG. 3*c* show top views illustrating various rack configurations and re-racking options for a drinking-game thermal-racking system according to other embodiments of the present invention.
Figure 3B:
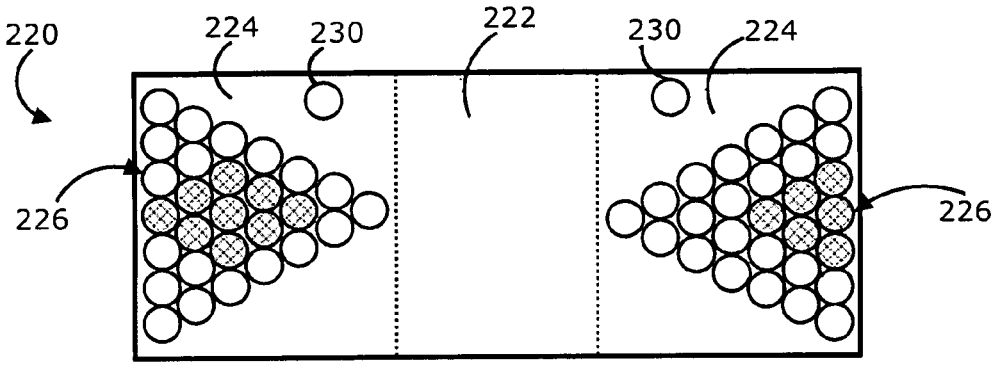
Figure 3C:
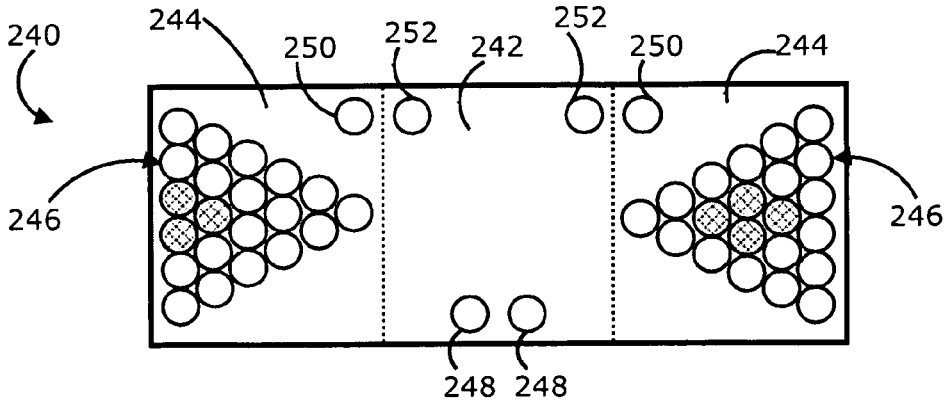

Drinking games may be played for an agreed upon number of cups, for example, six cups, ten cups, fifteen cups, twenty-one cups, twenty-eight cups, or other number, as shown. The number of cups selected may correspond to the size of the triangular formation to be used during game play. The number of cups may vary also if an alternative formation may be used, such as, for example, a diamond formation or a grid formation. FIG. 3*a*, FIG. 3*b*, and FIG. 3*c* show top views illustrating various rack configurations and re-racking options for a drinking-game thermal-racking system according to other embodiments of the present invention. FIG. 3*a* shows a drinking-game thermal-racking system 200 with a pre-configured ten cup formation of cup holders 206 in each rack area 204 within playing surface 202, as shown. FIG. 3*b* shows a drinking-game cup chilling system 220 with a pre-configured twenty-eight cup formation of cup holders 226 in each rack area 224 within the playing surface 222, as shown. FIG. 3*c* shows a drinking-game thermal-racking system 240 with a pre-configured 21 cup formation of cup holders 246 in each rack area 244 within the playing surface 242, as shown. Considering all of the FIG. 3 diagrams, each drinking-game thermal-racking system may provide additional cup holders for other elements of plays, such as, for example, ball washers (for example 208, 248), penalty cup holders (for example 230, 250), warm penalty cup holders (252), in a variety of combinations, as shown. Additional cup holders may be required by variations in game rules.

Beer pong play may be played by four players, two per team. Each team may be assigned one end of playing surface 102, as shown. Drinking cups are placed in the rack areas 108, as shown. The object of the game may be to land the thrown projectiles in the drinking cups, which may require the opposing team to drink the beverage in the cup and remove the cup from play. Beverage is placed into the cups, for example, 4 ounces of beverage may be placed into each 16 ounce cup. Alternately, one cup may be denoted a "challenge cup" and may be filled with 16 ounces of beverage. Such a challenge cup may be placed in a cup holder that may be considered difficult to shoot, such as, for example, the front row or the rear back corners. Beverages may be alcoholic in nature. Each drinking cup holder in rack area 108 may contain a drinking cup prior to play.

Players may decide which team shoots first, by any method, such as, coin toss or player decision. Play may begin by having each player on shooting team throw one projectile toward the defending team's rack area. The rules may determine how a player is allowed to shoot, for example, the projectile may be required to bounce off the playing surface, the projectile may be blocked by the other team after a bounce, the projectile may not be allowed to bounce more than twice, the projectile may not be thrown underhand, etc. The rules may allow the other team to defend their rack area by a variety of methods, for example, the defending team may block the shot after a bounce, the defending team may block the shot after two or more bounces, the defending team may eject the projectile that is "spinning" in a drinking cup before it touches the beverage, etc. A penalty may occur whenever a shot or a defense rule is not observed, which may require drinking from a penalty cup, such as penalty cup 110, as shown. Penalty cups may not be removed from play, but rather, refilled with beverage in anticipation of the next penalty. Some rules may provide that a difficult shot, such as a bounce shot, may require the removal of two or more cups.

When the projectile lands within a cup, the defending team may remove the cup, drink the contents and remove the cup from play. When both projectiles land in the defending team's cups, the defending team may lose its turn and the same team may continue to shoot. When only one projectile or no projectiles land in the defending teams cups, the shooting team's turn may end, and the defending team may take possession of the projectiles and become the shooting team.

When a penalty occurs, the player committing the penalty may be required to drink from the penalty cup 110. Alternately, the player may be required to drink from a penalty cup in the warming drinking cup 112, as shown. If both types of penalty cups are available, the rules may provide for which penalties require drinking from a cool cup and which penalties require drinking from a warm cup.

As drinking cups are removed from play, the remaining cups may become spread out across the formation, thereby requiring precise shooting. This may slow down game play. The rules may provide that re-racking may occur after each turn when there are a specified number of drinking cups remaining, for example, re-racking into a diamond formation with nine drinking cups, re-racking into a triangle formation at six drinking cups, re-racking into a diamond formation at four drinking cups, re-racking into a triangle formation at three drinking cups, etc. These re-racking formations may be achieved on playing surface 102, as shown.

Turning again to the diagrams of FIG. 3, on the left side of the FIG. 3*a*, cup holders 206 are shown as filled (indicated by the hatch marks). On the right side of the FIG. 3*a*, the cup holders are shown partly filled (indicated by the hatch marks) and partly empty (as indicated by the empty circles), which may be the result of re-racking when the last turn played left only six cups on the left side of the table, as shown. FIG. 3*b* shows other re-racking possibilities, for example, the left side of FIG. 3*b* shows a diamond formation of nine cups after a nine cup re-rack. The right side of FIG. 3*b* shows a six cup triangular formation after a six-cup re-rack. Also, other possibilities for location of the re-rack may be possible, for example, placing the re-racked cups closer to the opposing team for easier shooting, scoring and faster game play. Likewise, positioning the re-rack in a corner may make for more difficult shooting, scoring and possibly slower game play. Additionally, the re-rack may be move from turn to turn to prevent the opposing team from becoming comfortable with the range and angle of the shots, according to the rules agreed upon by the players. FIG. 3*c* shows further re-racking possibilities, for example, on the left side of FIG. 3*c*, a three cup triangular formation re-rack is shown. On the right side of FIG. 3*c*, a four cup diamond formation is shown.

Figure 4A:
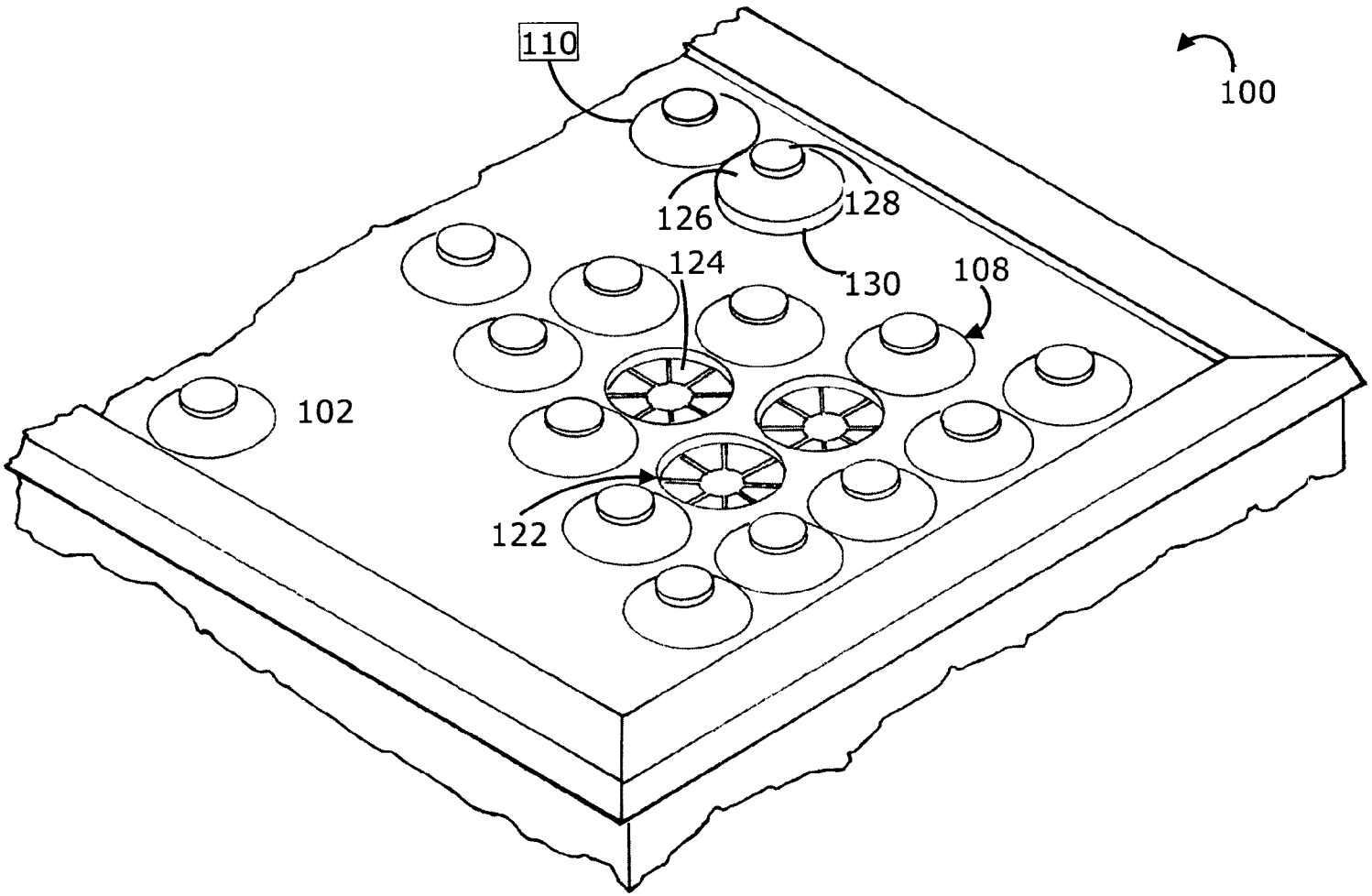
FIG. 4*a*, FIG. 4*b*, and FIG. 4*c* show top views illustrating various re-racking options according to the embodiment of FIG. 1.
Figure 4B:
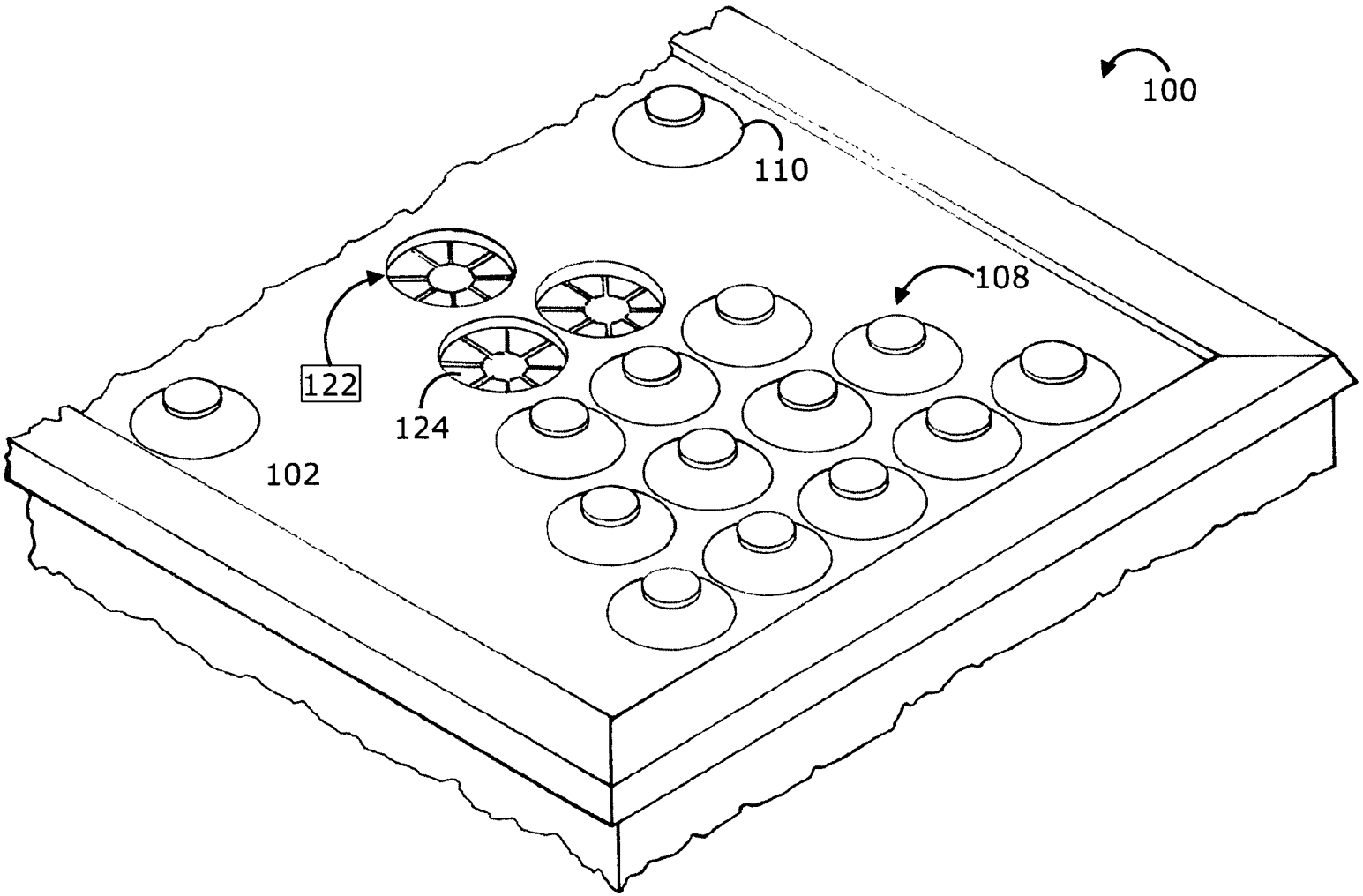
Figure 4C:
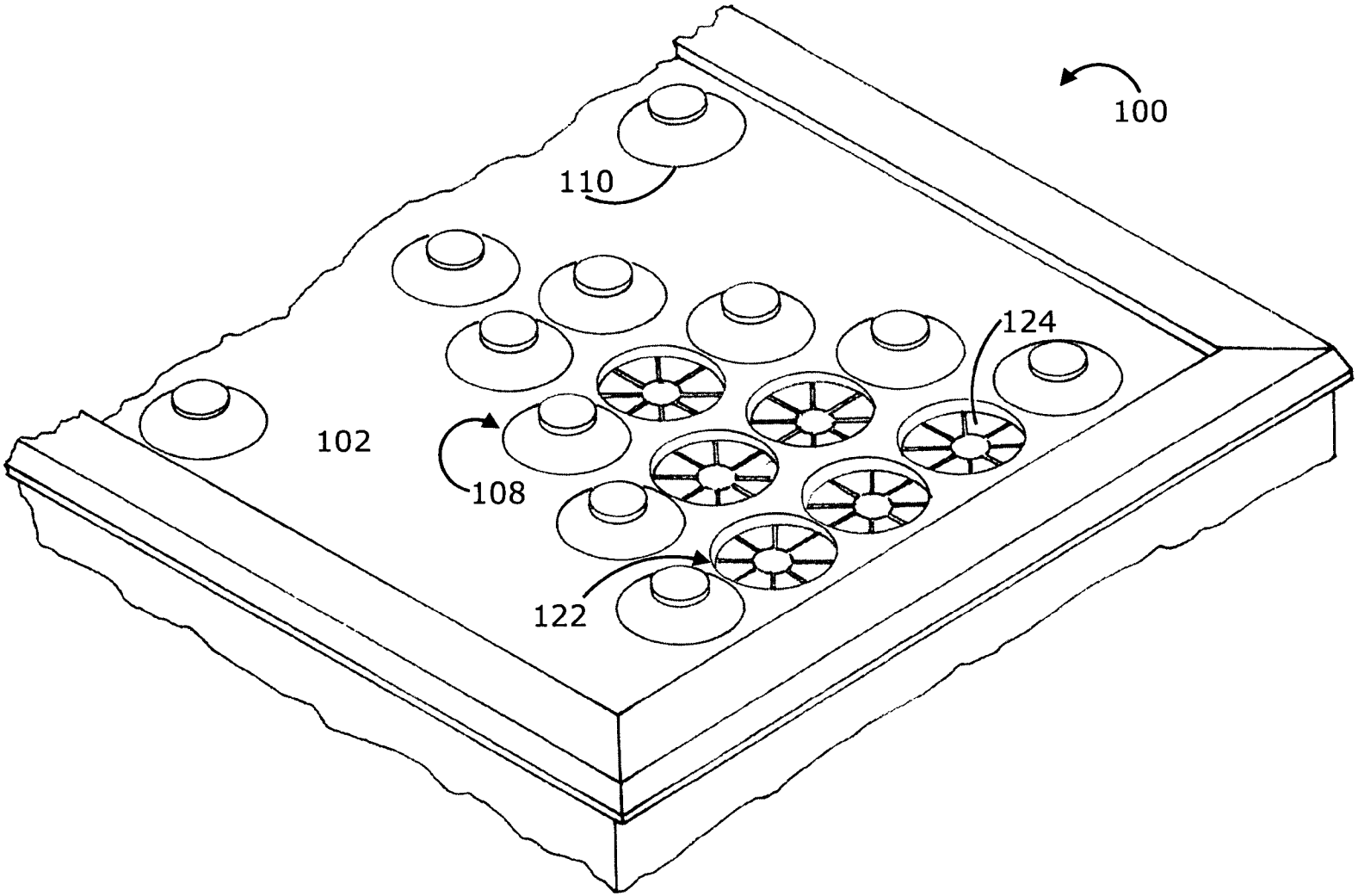

FIG. 4*a*, FIG. 4*b*, and FIG. 4*c* shows a top view illustrating various re-racking options according to the embodiment of FIG. 1. FIG. 4*a* shows a three cup, triangular re-rack. FIG. 4*b* shows a three cup, triangular re-rack at an "easy" shooting location near the front of the rack area. FIG. 4*c* shows a six cup triangular re-rack.

Upon reading the teachings of this specification, those with ordinary skill in the art will now realize that, under appropriate circumstances, considering such issues as economic considerations, advances in technology, user preference, etc., other types of rack configurations, such as, for example, using a grid shape, square shape, grid shape with rows with ½ cup offsets, other geometric shapes, etc., may suffice.

FIG. 4*a* shows cup holder opening 122, which may be encircled by fringed gasket 124, as shown. Fringed gasket 124 and cup holder opening 122 may be structured to allow a drinking cup to rest and be held within while sealing the opening and preventing leaking of the thermal cooling area below, as shown. When re-racking, three cup holder openings may receive drinking cups, as shown, and the remaining cup holder openings may contain lids, such as lid 126, as shown. Lid 126 may have a handle 128 and may have its lower surface covered in plastic or rubber 130, as shown. Handle 128 may allow removal and replacement of lid 126 when lid 126 may be disposed substantially within the playing surface 102, as shown with other lids on the playing surface 102. Lid 126 may be structured to fit within and close up the fringed gasket 124 and cup holder opening 122 similar to a drinking cup, as shown. This arrangement may prevent the cooler temperatures below the playing surface 102 from leaking through the cup holder openings 122, as shown.

Alternately, other embodiments may provide for additional methods of allowing drinking cups to be held and removed from the drinking-game thermal-racking systems. For example, a rubber gasket may be used instead of a fringed gasket. For example, the lid may be positioned within the cup holder opening on a spring, track or some combination. When placing a drinking cup upon the lid, the spring or track may move or retract within body 104. Likewise, when the drinking cup is removed, the lid may again move up into position of filling and closing the cup holder opening by operation of the spring or track, thereby re-forming the seal and reducing leaking of the cooler air below.

Alternately, the cup holder may be a fixed shaped without moving parts, similar to the shape of the cup, which may minimize direct leaking of cool air, yet may still allow a cup within the holder to be cooled.

Upon reading the teachings of this specification, those with ordinary skill in the art will now realize that, under appropriate circumstances, considering such issues as game rule variations, commercially available drinking cup sizes, cooling requirements, beverage type, economic considerations, advances in technology, user preference, etc., other types of cup holders, such as, for example, using a fixed cup holder, re-sizeable cup holder, a vented cup holder, a removable cup holder, etc., may suffice.

The game may end when one team has had all of its drinking cups removed from play. The rules may provide that a team that has lost all of its cups may take a final turn, e.g. the team may shoot until it fails to land a projectile into the other team's cup, and this rule may be known as the "rebuttal" or the "redemption."

Figure 5A:
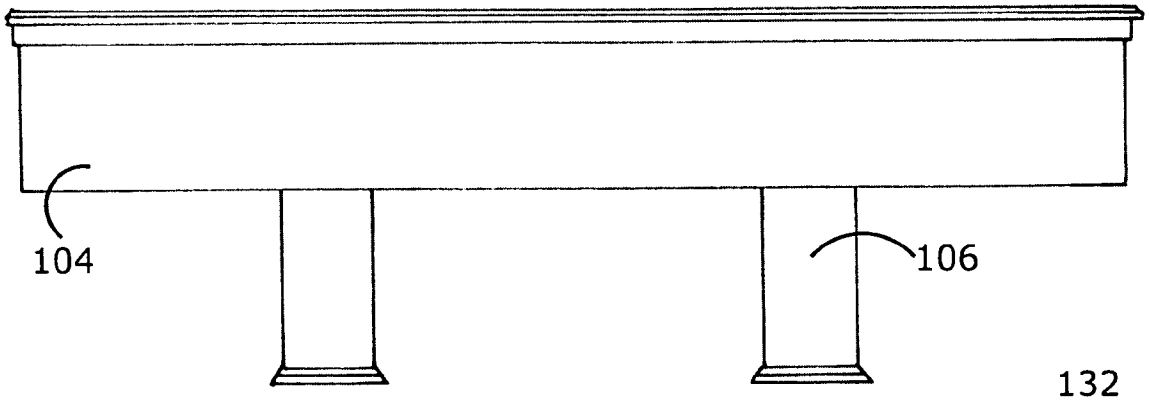
FIG. 5*a* and FIG. 5*b* show side views of a drinking game cup thermal-racking system according to the embodiment of FIG. 1
Figure 5B:
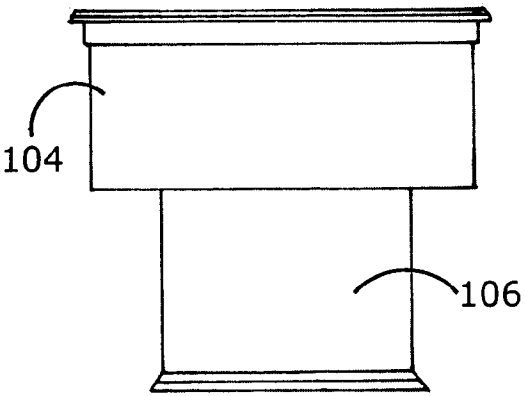
Figure 5C:
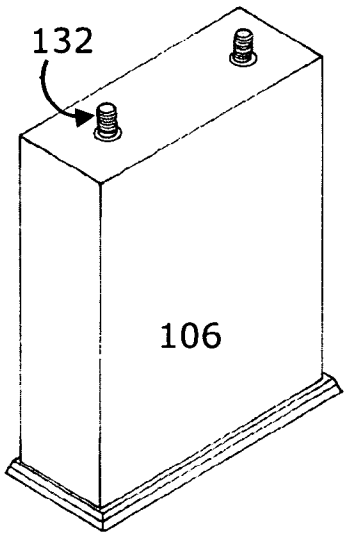
FIG. 5*c* shows a perspective view of a base support of a drinking game cup thermal-racking system according to the embodiment of FIG. 1.

FIG. 5*a* and FIG. 5*b* show side views of a drinking game cup thermal-racking system according to the embodiment of FIG. 1. FIG. 5*c* shows a perspective view of a base support of a drinking game cup thermal-racking system according to the embodiment of FIG. 1. Considering FIGS. 5*a* to 5*c*, the drinking-game thermal-racking system may provide for a table body 104 and table legs 106, as shown. Table legs 106 may be connected to the table body by fasteners 132 (see also FIG. 8*a* and FIG. 8*b*), such as the nut and bolt faster, where the bolt is embedded within the table legs 106, as shown. Playing surface may be constructed of wood, stone, plastic or combinations. Playing surface 102 may be constructed of wood flooring. Playing surface may be constructed of stone, manufactured stone, such as, for example, building materials sold under the band name "CORIAN" by 3M or other resin acrylic composites or stone plus resin acrylic deposits. The material may be selected for its resistance to staining, due to spilled beverages that may occur during game play. The material may be selected for its bounce characteristics for the type of thrown projectile that may be used. The material may be selected for it thermal conductive or thermal insulating characteristics. For example, a thermally insulating material may be chosen to improve efficiency of the cooling system or provide for lower beverage temperatures. Also, a thermally conductive material may be chosen to provide feedback to the user that the table is operating to cool the drinking beverage and possibly to encourage game play. A coating may be applied to the playing surface to promote any of these characteristics, e.g. spill-resistance, thermal insulation, bounce-properties, etc., or other characteristics that may effect game play.

Upon reading the teachings of this specification, those with ordinary skill in the art will now realize that, under appropriate circumstances, considering such issues as thermal insulating or conductive properties, stain-resistance, lighting effects, rebound properties of thrown projectile, game rules, promotion of game play, economic considerations, advances in technology, user preference, etc., other types of playing surface materials, such as, for example, using injection-molded plastic, commercially available household flooring, sealed stones, marble, granite, tile, sealing or coating, etc., may suffice.

Figure 6:
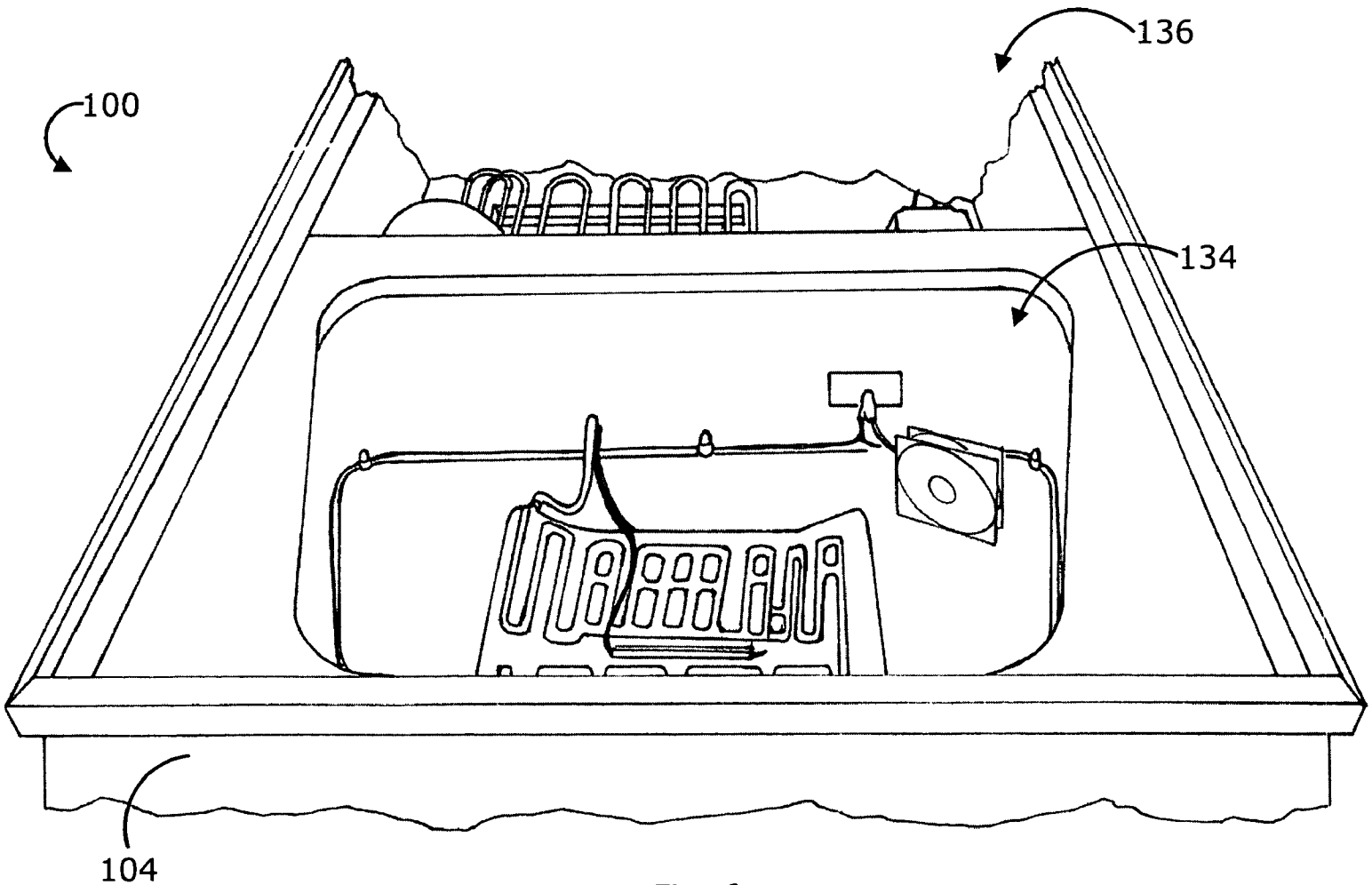
FIG. 6 shows a perspective view illustrating a drinking-game thermal-racking system with the top surface removed according to the embodiment of FIG. 1.
Figure 9:
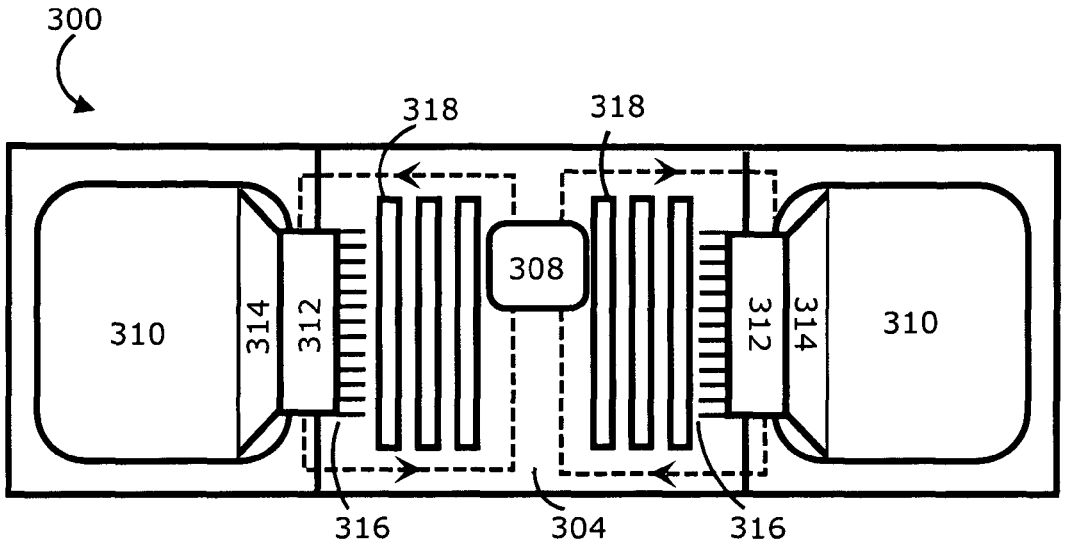
FIG. 9 shows a top view of a thermal-electric cooler (TEC) of a drinking-game thermal-racking system according to the embodiment of the present invention.

FIG. 6 shows a perspective view illustrating a drinking-game thermal-racking system with the top surface removed according to the embodiment of FIG. 1. FIG. 9 shows the table body 104 with the top surface removed to show the cooling area 134 and the warming area 136.

Figure 7:
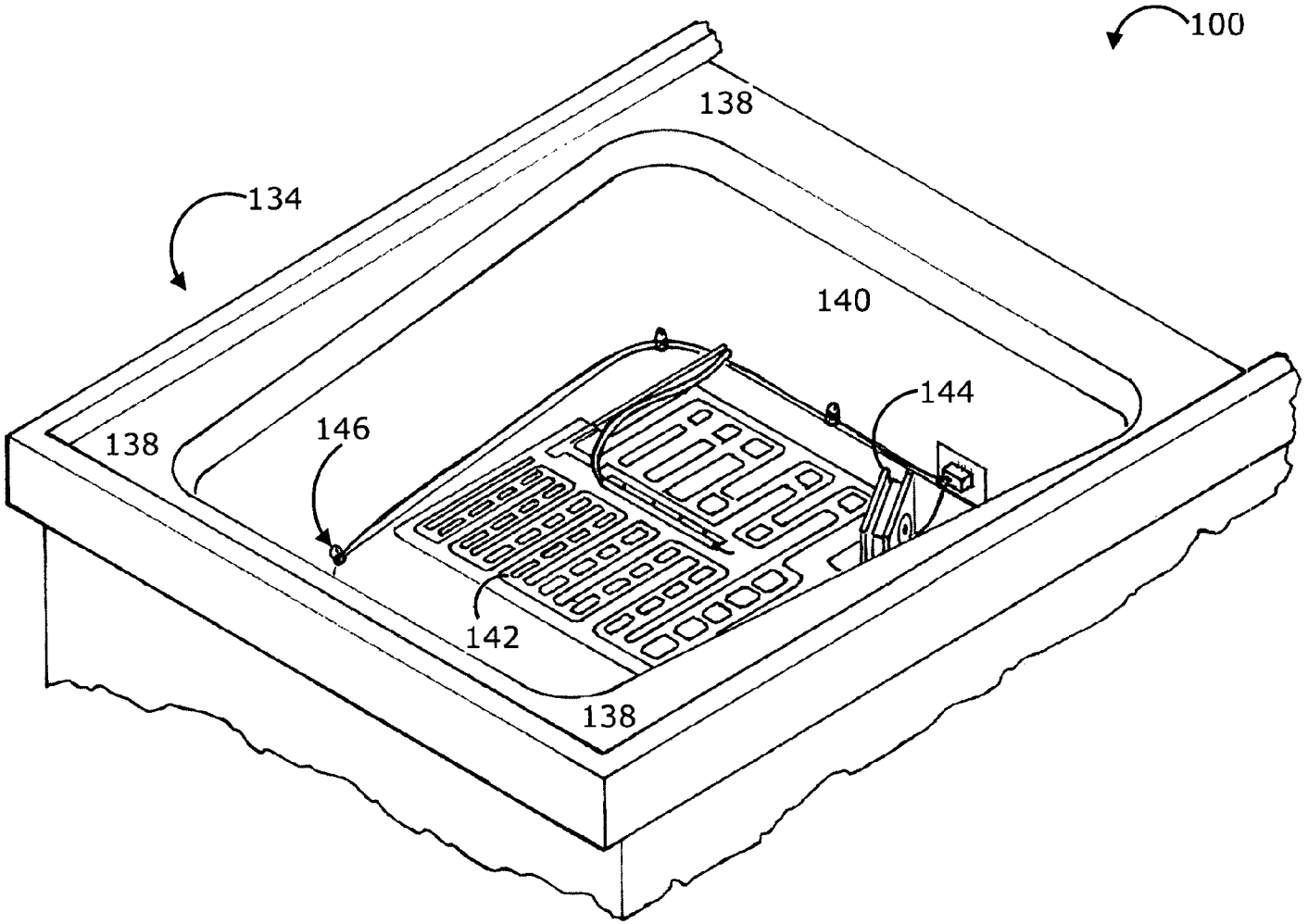
FIG. 7 shows a perspective view of an insulating enclosure with an evaporative coil and a fan of a drinking-game thermal-racking system according to the embodiment of FIG. 1.

FIG. 7 show a perspective view of the cooling area including an insulating enclosure with an evaporative coil and a fan of a drinking-game thermal-racking system 100 according to the embodiment of FIG. 1. Cooling area 134 may provide for air cooling of the area below the rack area 108, as shown. Cooling area 134 may be surrounded by insulating material 138, which may provide for thermal insulating the area, as shown. Cooling area 134 may have liner 140, as shown. Liner 140 may be spill-resistant, may be water-proof, and may allow for easy cleaning, as shown. Liner 140 may also provide some thermal insulation. Evaporator coil 142 may provide for cooling of the air within cooling area 134, as shown. Fan 144 may provide for circulation of air within the cooling area 134, which may provide for uniform cooling and may provide more efficient operation of the cooling area, as shown. Alternately, in other embodiments, air cooling may be substituted for liquid cooling or direct cooling of the cup holders. Evaporator coil 142 may be positioned above the lining 140 to allow air circulation around all sides of evaporator coil 142.

Upon reading the teachings of this specification, those with ordinary skill in the art will now realize that, under appropriate circumstances, considering such issues as cooling efficiency, lighting, temperature uniformity within the cooling area, economic considerations, advances in technology, user preference, etc., other types of insulator and seals and enclosures, such as, for example, using a portion of the playing surface as an insulator, plastic enclosures, clear plastic seals, rubber seals, building insulation, packaging materials, etc., may suffice.

Upon reading the teachings of this specification, those with ordinary skill in the art will now realize that, under appropriate circumstances, considering such issues as cooling efficiency, lighting, temperature uniformity within the cooling area, economic considerations, advances in technology, user preference, etc., other types of arrangements of insulators and cooling areas, such as, for example, using a separate cooling area for each drinking cup holder, using different shapes of cooling areas, using a single cooling area within a table, locating the warming area outside of the table body, etc., may suffice.

Lights 146 may provide lighting of the cooling area 134, and may be positioned around the cooling area 134, as shown. Lights 146, may be colored LED lighting, for example, 12 volt light emitting diodes, that may be capable of illuminating the cup holder openings 122, the fringed gaskets 124, and the drinking cups, for example, when the drinking cups have a translucent or clear quality. The fringed gasket 124, the cup holder openings 122 and other structure for moveably closing the cup holder openings 122 may be selected for its opacity, translucency, or clarity in combination with the color and quantity of the lighting provided by lights 146, as shown. Additionally, other structures may be lighted, such as, for example, the table body 104, the table legs 106 or the surface area 102. It may be desirable to allow some thermal leaking to provide for lighting on or around the cup holders or cups, or other lighted structures, such as, for example, to encourage game play.

Upon reading the teachings of this specification, those with ordinary skill in the art will now realize that, under appropriate circumstances, considering such issues as lighting amount, color, economic considerations, advances in technology, user preference, etc., other types of lights, such as, for example, using a neon light, etc., may suffice.

Figure 8A:
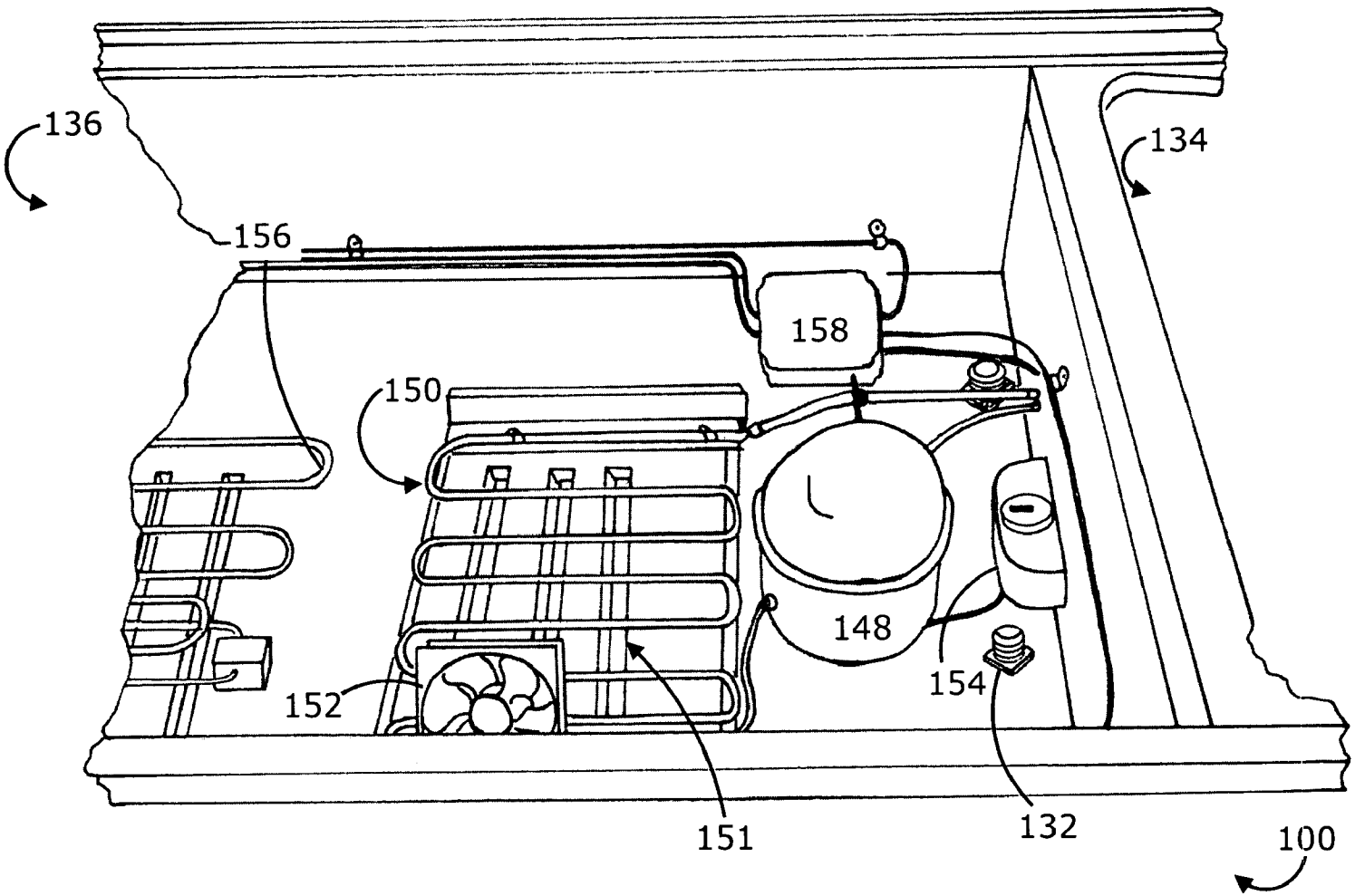
FIG. 8*a* and FIG. 8*b* show perspective views of a compressor and condensing coil of a drinking-game thermal-racking system according to the embodiment of FIG. 1.
Figure 8B:
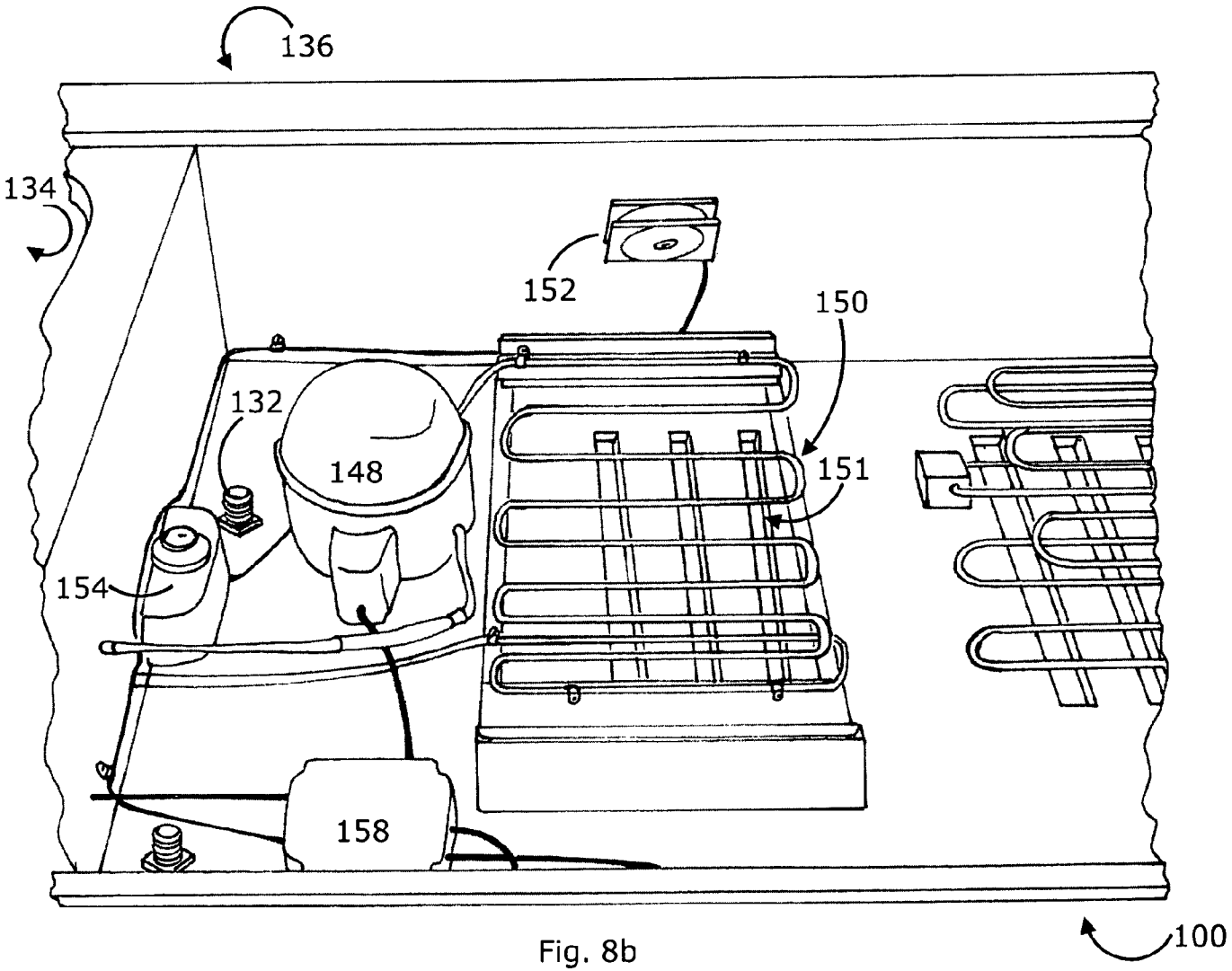

FIG. 8*a* and FIG. 8*b* show perspective views of a compressor and condensing coil of a drinking-game thermal-racking system according to the embodiment of FIG. 1. Warming area 136 contains compressor 148, as shown. Compressor 148 may provide an air-tight pump suitable for compressing gaseous refrigerant and an electric motor to crank the pump, as shown. Compressor 148 may be any commercially available model, such as those sold commercially by LG. Compressor 148 may be operably connected the condensing coil 150, as shown. Compressor 148 compresses gaseous refrigerant and forces it into the condensing coil 150, as shown. Compressor 148 may be controlled by temperature controller 154, which may sense the temperature of the cooling area and turn the compressor on and off, as shown. The condensing coil 150 allows the high-pressure gas to cool and conducts heat away from the refrigerant. The waste heat may be vented through the vent 151 by fan 152, as shown. Some waste heat may also rise within the warming area 136, as shown, and allow warming of the warming cup holders 112, as shown. Next, the high-pressure, gaseous refrigerant passes through an expansion valve and then into the evaporator coil 142, where the refrigerant expands, removing thermal energy from the cooling area, and cooling the surrounding environment to a temperature sufficient to cool the drinking cups to a palatable temperature. The warming area also contains the AC power receptacle which is connected to the DC voltage supply 158 and the compressor 148, as shown. The warming area also contains the DC voltage supply 158 which may power the lights 146, as shown. The DC voltage supply may also produce waste heat when transforming power from AC to DC current.

FIG. 9 shows a top view of a thermal-electric cooler (TEC) of a drinking-game thermal-racking system according to the embodiment of the present invention. In this embodiment, the vapor-compression refrigerator of the FIG. 1 embodiment may be replaced with a thermo-electric cooler 312, such as a Peltier effect cooler, as shown. Thermo-electric cooler 312 may be powered by DC power supply 308, which may be sufficient to cool the cooling area 310 to a temperature sufficient to cool the drinking cups to a palatable temperature. The thermo-electric cooler 312 contains a cooling element 315 and a heat sink 316, as shown. The heat sink may provide waste heat to warm the warming area 314, which may be vented by vent 318, as shown. The cooling element removes heat from the surrounding environment causing cooling of the environment within cooling area 310, as shown.

Upon reading the teachings of this specification, those with ordinary skill in the art will now realize that, under appropriate circumstances, considering such issues as cooling efficiency, waste-heat production, economic considerations, advances in technology, user preference, etc., other types of electric coolers, such as, for example, using a evaporative-coolers, Peltier coolers, heat pumps, vapor-compression refrigerators, etc., may suffice.

For the purposes of the claims, the term "any" shall have its common dictionary definition: "one, some, or all indiscriminately of whatever quantity; one or more: not none;" i.e. the term "any" is used as a function word to indicate a positive but undetermined number or amount. The term "any" shall not mean only: "maximum or whole of a number of quantity." Likewise, the expression "any space between" shall mean any part or portion of space between the specified objects, including, but not limited, to the entire space.

Although applicant has described applicant's best mode and other embodiments of the present Drinking-game thermal-racking systems, it will be understood that the broadest scope of this invention includes such modifications as diverse materials, shapes, sizes, etc. Such scope is limited only by the below claims as read in connection with the above specification. Further, many other advantages of applicant's invention will be apparent to those skilled in the art from the detailed descriptions and the claims.

We claim:

1. An apparatus comprising:

a) a playing surface to play a drinking game using a plurality of drinking cups and thrown projectiles;

b) a rack, contained within said playing surface, to rack up a pre-determined configuration of the drinking cups suitable to play the drinking game, i) wherein said rack comprises an insulator to at least partially insulate the drinking cups while the drinking cups are contained within said rack; and c) an electric cooler structured and arranged to cool electrically the drinking cups while the drinking cups are contained within said rack and to discharge waste heat away from said rack.

2. The claim of claim 1 wherein:

a) said playing surface comprises a material selected from the group consisting of stone, acrylic resin and combinations thereof.

3. The claim of claim 1 wherein:

a) said playing surface comprises i) a projectile washer, contained within the playing surface and not contained within the insulator, to wash the thrown projectiles;

ii) wherein said electric cooler further comprises a waste-heat discharger structured and arranged to discharge waste heat along said projectile washer to warm said projectile washer.

4. The claim of claim 1 wherein:

a) said playing surface comprises i) a penalty drinking-cup holder, contained within the playing surface and not contained within the insulator, to hold a drinking-cup designated for a penalty accorded by the rules of the drinking game;

ii) wherein said electric cooler further comprises a waste-heat discharger structured and arranged to discharge waste heat along said penalty drinking-cup holder to warm the penalty drinking-cup.

5. The claim of claim 1 wherein:

a) said electric cooler comprises a cooler selected from the group consisting of vapor-compression refrigerator, evaporative cooler, thermo-electric cooler, and combinations thereof.

6. The claim of claim 1 wherein:

a) said electric cooler comprises a temperature control to control the temperature of the drinking cups.

7. The claim of claim 1 wherein:

a) said rack comprises a diamond formation to hold drinking cups.

8. The claim of claim 1 wherein:

a) said rack comprises a triangular formation to hold drinking cups.

9. The claim of claim 8 wherein:

a) said rack further comprises a triangular formation of fifteen apertures to hold drinking cups with one aperture in the first row, two apertures in the second row, three apertures in the third row, four apertures in the fourth row, and five apertures in the fifth row.

10. The claim of claim 8 wherein:

a) said rack further comprises a triangular formation of fifteen apertures to hold drinking cups with one aperture in the first row, two apertures in the second row, three apertures in the third row, four apertures in the fourth row, five apertures in the fifth row, and six apertures in the sixth row.

11. The claim of claim 8 wherein:

a) said rack further comprises a triangular formation of fifteen apertures to hold drinking cups with one aperture in the first row, two apertures in the second row, three apertures in the third row, four apertures in the fourth row, and five apertures in the fifth row, six apertures in the sixth row, and seven apertures in the seventh row.

12. The claim of claim 1 wherein:

a) said rack comprises an aperture to hold a drinking-cup designated for a penalty accorded by to the rules of the drinking game.

13. The claim of claim 1 wherein:

a) said rack comprises a plurality of apertures in the playing surface to allow the drinking cups when placed within the plurality of apertures to extend below the top of said playing surface and to hold the top of the drinking cup substantially level with the top of said playing surface.

14. The claim of claim 13 wherein:

a) said insulator comprises a seal to seal any space between said plurality of apertures and the drinking cups.

15. The claim of claim 13 wherein:

a) said insulator comprises an enclosure to thermally enclose any space between the rack, the bottom of the playing surface, and the plurality of apertures.

16. The claim of claim 13 further comprising:

a) a light, affixed between the playing surface and the insulator, to light said plurality of apertures.

17. The claim of claim 13 wherein:

a) said insulator comprises
   i) a plurality of movable closures to close movably said plurality of apertures;
   ii) a seal to seal any space between said plurality of apertures, the drinking cups and said plurality of movable closures; and
   iii) an enclosure to enclose thermally any space between said playing surface, said rack, and said plurality of apertures.

18. The claim of claim 17 wherein:

a) said plurality of apertures further comprises a triangular formation of fifteen apertures to hold drinking cups with one aperture in the first row, two apertures in the second row, three apertures in the third row, four apertures in the fourth row, and five apertures in the fifth row.

19. The claim of claim 18 wherein:

a) said playing surface comprises a material selected from the group consisting of wood, stone, acrylic resin, and combinations thereof;

b) said playing surface further comprises
   i) a projectile washer, contained within the playing surface and not contained within the insulator, to wash the thrown projectiles;
   ii) wherein said electric cooler further comprises a waste heat discharger structured and arranged to discharge waste heat along said projectile washer to warm said projectile washer;

c) said rack comprises a penalty-cup holder to hold a drinking cup designated for a penalty accorded by the rules of the drinking game;

d) said electric cooler comprises a vapor-compression refrigerator; and e) said electric cooler comprises a temperature control to control the temperature of the drinking cups.

20. The claim of claim 1 wherein:

a) said playing surface comprises wood.

21. An apparatus comprising:

a) drinking-game playing means for playing a drinking game upon a playing surface using a plurality of drinking cups and thrown projectiles;

b) raking-up means for racking up a pre-determined configuration of the drinking cups upon the said playing surface,
   i) wherein said racking up means comprises insulating means for thermally insulating the drinking cups while the drinking cups are contained within said racking-up means; and c) electric-cooling means for cooling electrically the drinking cups while the drinking cups are contained within said racking-up means and for discharging waste heat away from said racking-up means.

22. The claim of claim 21 wherein:

a) said racking-up means comprises cup-holding means for holding the drinking cups within the playing surface and for allowing the drinking cups to extend below the top of said playing surface and for holding the top of the drinking cup levelly with the top of said playing surface;

b) said insulating means comprises
   i) movable-closing means for closing movably said cup-holding means,
   ii) sealing means for sealing any space between said cup-holding means, movable-closing means, and the drinking cups, and
   iii) thermal-enclosing means for enclosing thermally any space between said playing surface, said racking means, and said cup-holding means;

c) said cup-holding means further comprises a triangular formation of fifteen apertures to hold drinking cups with one aperture in the first row, two apertures in the second row, three apertures in the third row, four apertures in the fourth row, and five apertures in the fifth row;

d) said playing surface further comprises
   i) projectile-washing means, contained within the playing surface and not contained within insulating means, for washing the thrown projectiles;
   ii) wherein said electric-cooling means further comprises waste-heat-discharging means structured and arranged for discharging waste heat along said projectile-washing means to warm said projectile-washing means;

e) said racking means comprises a penalty-cup-holding means to hold a drinking-cup designated for a penalty according to the rules of the drinking game; and f) said electric-cooling means comprises temperature controlling means for controlling the temperature of the drinking cups.

* * * * *